US006132228A

United States Patent [19]

Lang

[11] Patent Number: 6,132,228

[45] Date of Patent: Oct. 17, 2000

[54] LEVER FOR CARD EDGE CONNECTOR

[75] Inventor: Harold Keith Lang, Fox River Grove, Ill.

[73] Assignee: Molex Incorporated, Lisle, Ill.

[21] Appl. No.: 09/084,181

[22] Filed: May 26, 1998

[51] Int. Cl.[7] ..... H01R 13/62

[52] U.S. Cl. ..... 439/160

[58] Field of Search ..... 439/157, 160, 439/328

[56] References Cited

U.S. PATENT DOCUMENTS

| | | | |
|---|---|---|---|
| 5,074,800 | 12/1991 | Sasao et al. | 439/157 |
| 5,082,459 | 1/1992 | Billman et al. | 439/637 |
| 5,163,847 | 11/1992 | Regnier | 439/157 |
| 5,167,517 | 12/1992 | Long | 439/160 |
| 5,207,598 | 5/1993 | Yamada et al. | 439/636 |
| 5,470,240 | 11/1995 | Suzuki | 439/157 |
| 5,511,985 | 4/1996 | Noschese et al. | 439/157 |
| 5,542,854 | 8/1996 | Bowen | 439/157 |
| 5,634,803 | 6/1997 | Cheng et al. | 439/157 |
| 5,662,485 | 9/1997 | Yip et al. | 439/157 |
| 5,672,069 | 9/1997 | Cheng et al. | 439/160 |
| 5,676,555 | 10/1997 | Yu et al. | 439/157 |
| 5,676,561 | 10/1997 | Chiang | 439/328 |
| 5,690,499 | 11/1997 | Howell et al. | 439/157 |
| 5,766,031 | 6/1998 | Yeh | 439/328 |
| 5,846,095 | 12/1998 | Bowen | 439/157 |
| 5,957,708 | 9/1999 | Lin | 439/157 |

FOREIGN PATENT DOCUMENTS

| | | |
|---|---|---|
| 5-121130 | 5/1993 | Japan . |
| 7-312266 | 11/1995 | Japan . |

OTHER PUBLICATIONS

Redacted Molex Drawing entitled "Multikey DIMM Plastic Latch (17.8MM Version)" Dated Aug. 11, 1993.

Molex Drawing entitled ".050/ (1.27) Pitch Multi–Key 168 CKT DIMM Ram Assy 17.8mm Latch Sales DwG" Dated Oct. 10, 1994.

*Primary Examiner*—Neil Abrams
*Assistant Examiner*—Eugene G. Byrd

[57] ABSTRACT

A card edge connector assembly is adapted for receiving a printed circuit card having an insertion edge insertable into and removable from the connector assembly. The assembly includes an elongated dielectric housing having a card-receiving slot. A lever is pivotally mounted on the housing near an end of the slot. The lever includes a front face, a latch portion extending forwardly of the front face for engaging a notch in a side edge of the card, an ejector portion extending rearwardly of the front face for engaging the insertion edge of the circuit card at a corner thereof and ejecting the card from the slot in response to pivoting of the lever. A limiting portion limits longitudinal movement of a side edge of the card when the card is in the slot. A hollow area is provided between the ejector portion and the limiting portion for receiving the corner of the card when the lever is pivoted and the card is ejected.

15 Claims, 5 Drawing Sheets

LEVER FOR CARD EDGE CONNECTOR

FIELD OF THE INVENTION

This invention generally relates to the art of electrical connectors and, particularly, to an electrical connector assembly for receiving the edge of a printed circuit card having conductive pads along the edge thereof.

BACKGROUND OF THE INVENTION

Various electrical circuits, especially those associated with computer applications, are formed on one or both sides of circuit boards or similar substrates to form separate circuits which may be added to computers or other electronic devices after initial manufacture thereof. Whether such separate circuit boards are added during the initial manufacture or afterwards, they must be reliably connected to the main computer printed circuit board, commonly referred to in the art as a "mother" board. The separate printed circuit boards are commonly referred to as "daughter" boards.

Various connectors have been designed for permanent installation on the mother board and include means, such as a slot, for receiving the daughter board to provide a connection between the mother board circuitry and the daughter board circuitry. The daughter boards commonly are referred to as "edge cards" because one edge of the card has a plurality of contact portions or pads. The edge of the circuit card typically has a plurality of such contact pads spaced there along. One or both sides of the edge card may have such contact pads. This edge is inserted into the slot of the connector which includes a number of electrical contact portions which may be disposed along one or both sides of the connector slot for engaging the edge card contact pads. The connector contacts typically include tail portions for interconnection to the circuitry of the mother board mounted beneath or adjacent the connector.

With the ever-increasing miniaturization of the electronics of computers and other electronic devices and the ever-increasing density of the related connector assemblies, continuing problems occur in designing connectors for such use. This is particularly true with card edge connectors of the character described above.

One of the problems encountered with card edge connector assemblies is in providing means to assist insertion and/or ejection of the edge card from the card edge connector assembly. As the number of contact elements that engage the printed circuit card increases, the forces required for insertion and ejection of the card increase. One type of card ejection means which has proven effective for its intended purposes is an ejecting mechanism which comprises a relatively short ejector arm or lever mounted at one or both ends of an elongated connector housing, such as at a single point of engagement typically provided by a pivot means. Such ejector arms or levers place considerable limitations on the overall length of the connector and particularly the effective contact or terminal length of the connector. The length of the connector inherently limits the number of connections or terminals. When a given connector has a specified overall length, the ejector levers limit the number of connections available for use in that given or specified length.

The present invention is directed to solving these various problems by providing an improved connector/ejector lever assembly which is effective to increase the area available for making terminal connections as well as increase the forces applied by the lever.

SUMMARY OF THE INVENTION

An object, therefore, of the invention is to provide a new and improved card edge connector assembly for receiving a printed circuit card having an insertion edge insertable into and removable from the connector assembly.

In the exemplary embodiment of the invention, the connector assembly includes an elongated dielectric housing having opposite ends with a card-receiving slot between the ends and a plurality of terminal-receiving cavities along the slot. A plurality of conductive terminals are received in the cavities and have contact portions extending into the slot for engaging contact pads on the printed circuit card. A latch/ejector lever is pivotally mounted on the housing at each opposite end thereof. Each lever includes a latch portion for holding the circuit card inserted into the slot, an ejector portion for engaging the insertion edge of the card at a corner thereof and ejecting the card from the slot in response to pivoting the lever, and a limiting portion for limiting longitudinal movement of a side edge of the card when the card is inserted into the slot. The lever further includes a hollow area between the ejector portion and the limiting portion for receiving the corner of the circuit card when the lever is pivoted and the card is ejected.

As disclosed herein, each latch/ejector lever includes a groove for receiving the side edge of the printed circuit card. The ejector portion of the lever is formed by a bottom wall of the groove. The limiting portion of the lever is formed by an inside wall of the groove. The groove is formed in a front face of the lever, and the latch portion projects forwardly of the front face. The bottom wall of the groove which forms the ejector portion of the lever has a radiused edge for engaging the insertion edge of the circuit card.

Another feature of the invention is that each latch/ejector lever includes a bottom end which is bifurcated to define spaced flexible side walls. The hollow area of the lever extends between the flexible side walls. The side walls have detent means cooperating with detent means on the housing to releasably hold the lever in a latched position holding the circuit card inserted into the card-receiving slot.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 10:
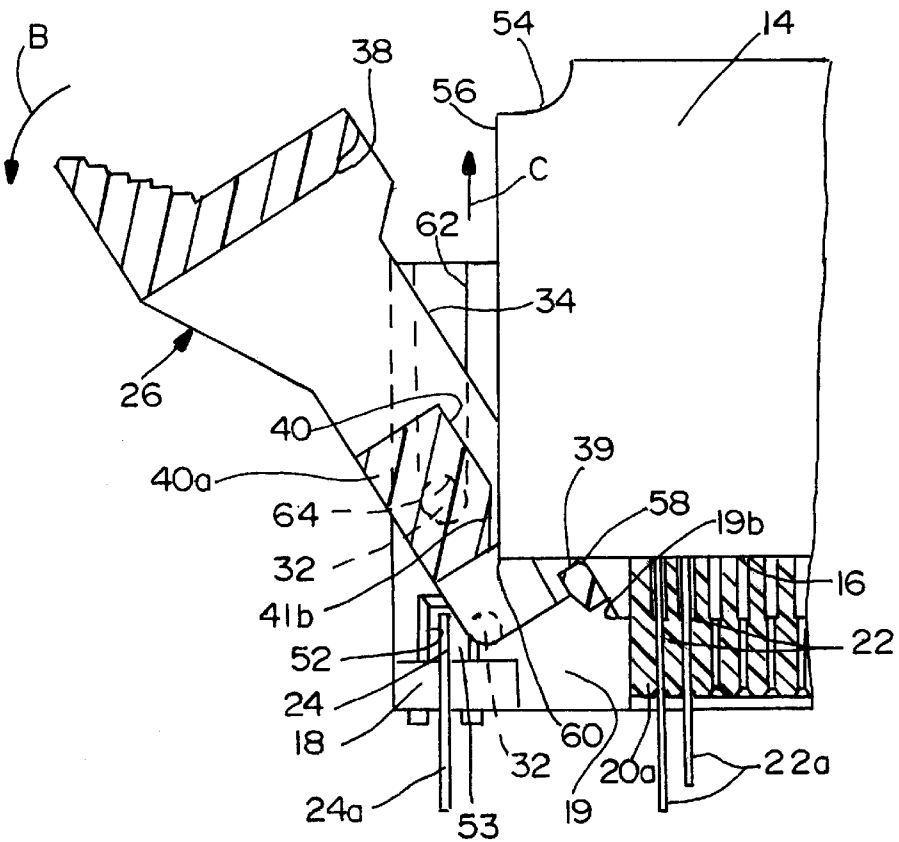
FIG. 10 is a view similar to that of FIG. 9, with the latch/ejector lever pivoted to eject the circuit card.
Figure 9:
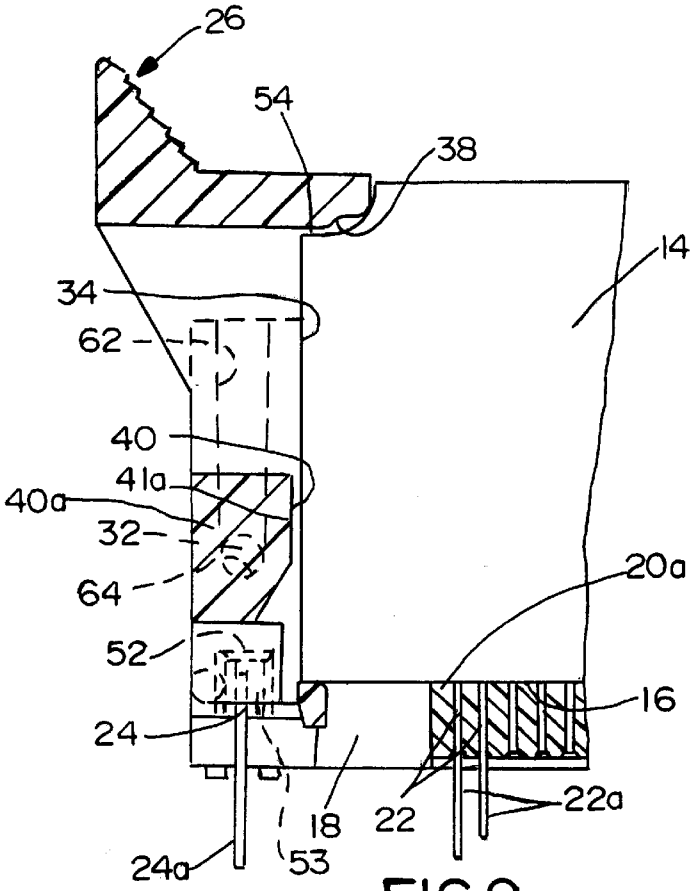
FIG. 9 is a fragmented, cut-away side elevational view of one end of the connector assembly, with a printed circuit card inserted and latched in the assembly.

Referring to the drawings in greater detail, and first to FIGS. 1–4, the invention is embodied in a card edge connector assembly, generally designated 12, for receiving a printed circuit card 14 which is shown in FIGS. 9 and 10 described hereinafter. Suffice it to say at this point, the printed circuit card has an insertion edge 16 insertable into and removable from the connector assembly. As is known in the art, the circuit card has circuitry printed thereon, with contact pads spaced along the insertion edge of the card on one or both sides thereof (both sides herein).

Figure 3:
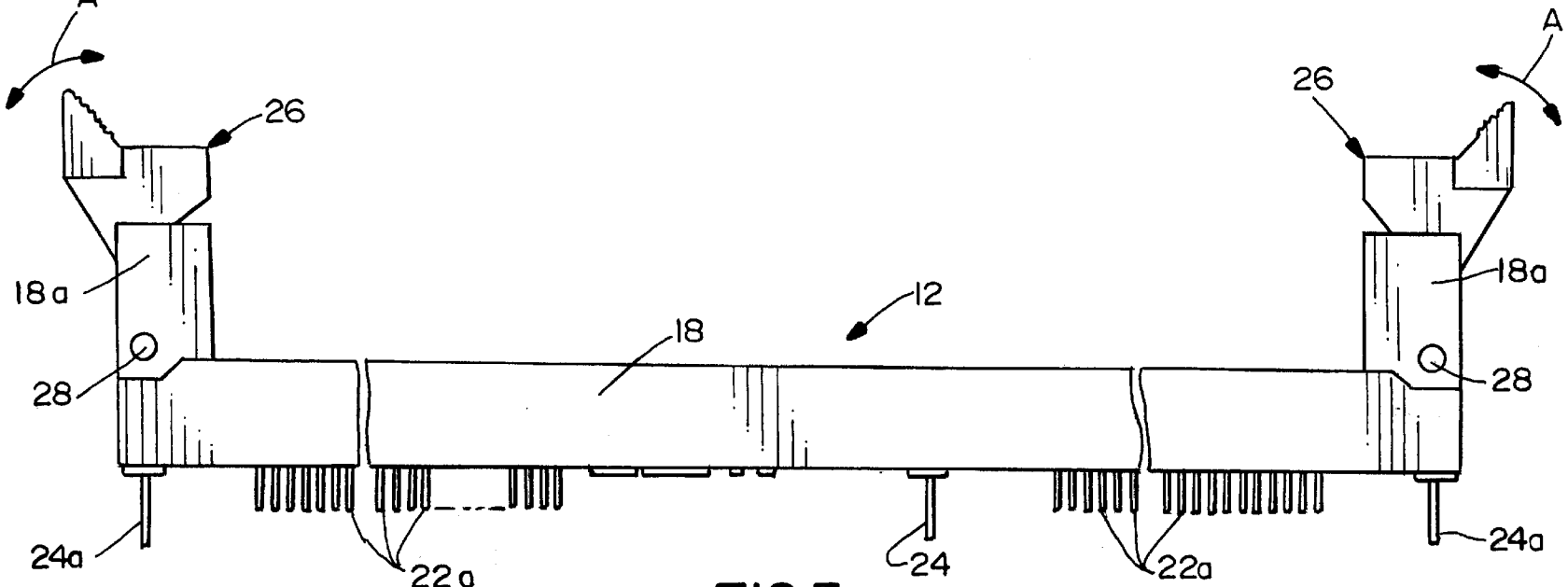
FIG. 3 is a side elevational view of the connector assembly.
Figure 4:
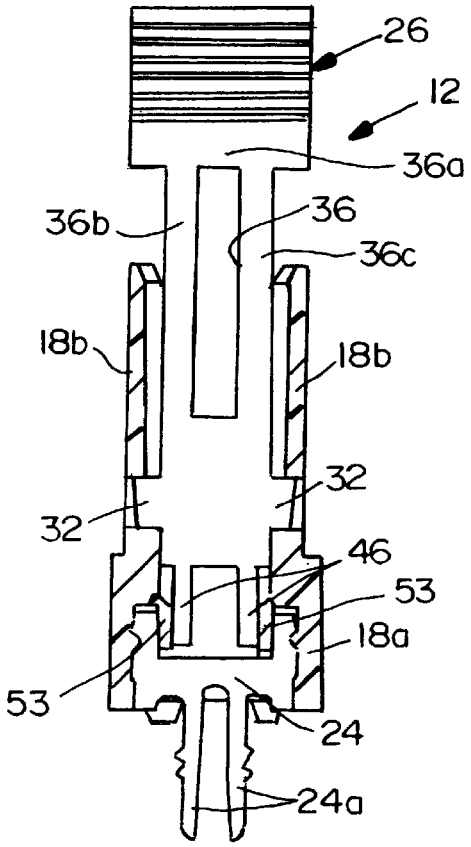
FIG. 4 is an end elevational section view of the connector assembly.

Card edge connector assembly 12 includes an elongated dielectric housing 18 having opposite ends 18*a*. A card-receiving slot, generally designated 20, extends between the opposite ends of the housing, and a plurality of terminal-receiving cavities are spaced along both sides of the slot. End walls 20*a* are disposed at the ends of the slot 20. A plurality of conductive terminals 22 are received in the cavities on opposite sides of slot 20. The terminals can take a variety of configurations but, as is known in the art, the terminals have contact portions extending into slot 20 for engaging the contact pads on opposite sides of printed circuit card 14. As best seen in FIG. 3, the terminals have tail portions 22*a* projecting from the bottom of housing 18 preferably for insertion into holes in a printed circuit board or for mounting on contact pads for connection to circuit traces on the board. Each end 18*a* includes upwardly standing opposed walls 18*b* and opposed inner walls 18*c* defining a slot 18*d* therebetween. Opposed upper edges of the inner walls 18*c* include card engaging sections 18*e*. The slot 18*d* is sufficiently wide to receive a side edge 56 of a circuit card 14. A recess 19 is provided between end walls 20*a* and inner walls 18*c*. Side walls of the recess 19 include bosses 19*a* with angled surfaces 19*b*.

As stated in the "Background", above, card edge connector assembly 12 is adapted for permanent mounting on a "mother" circuit board, whereupon printed circuit card 14 commonly would be called the "daughter" board. To that end, a plurality of board locks 24 are fixed within housing 18, one of the board locks being best visible in FIG. 4. Each board lock 24 has a pair of legs 24*a* for insertion into an appropriate mounting hole in the mother board.

Figure 1:
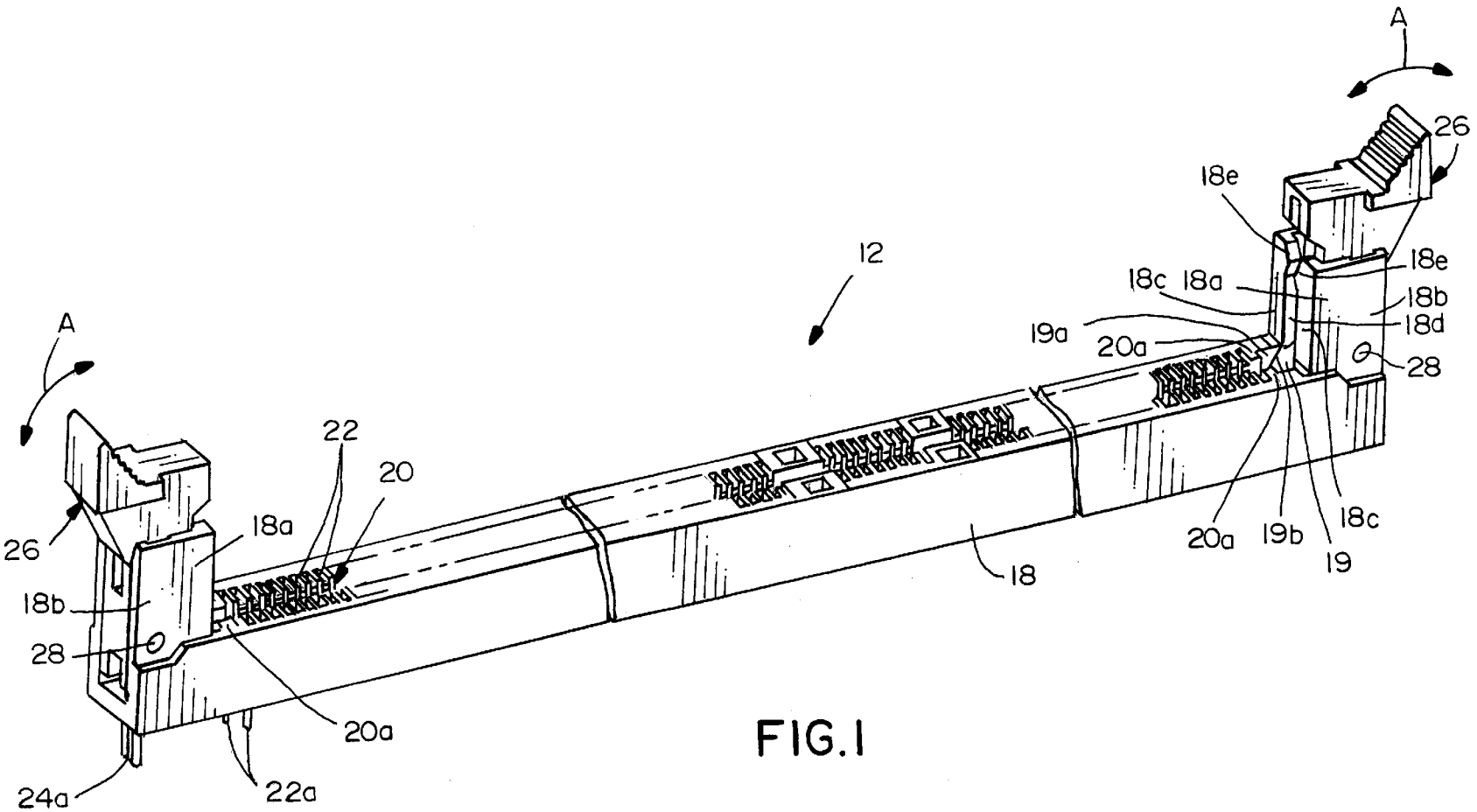
FIG. 1 is a perspective view of a card edge connector assembly embodying the concepts of the invention.
Figure 2:
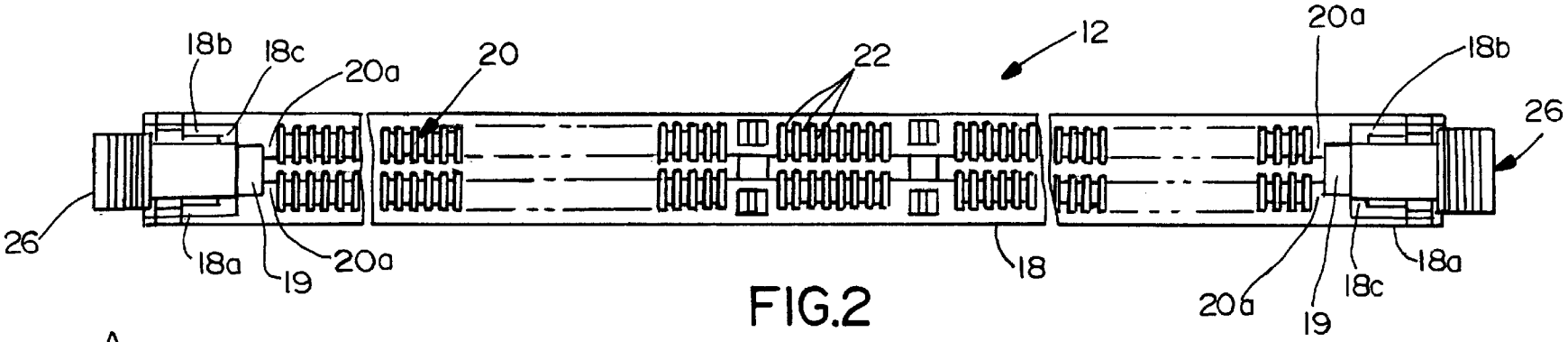
FIG. 2 is a top plan view of the connector assembly.

Generally, card edge connector assembly 12 includes a latch/ejector lever, generally designated 26, mounted at each opposite end 18*a* of housing 18. The levers are pivotally mounted to the housing for rotation about pivot points 28 in the direction of double-headed arrows "A" (FIGS. 1 and 3).

More particularly, FIGS. 5–8 show one of the latch/ejector levers in greater detail. Each lever is a one-piece structure unitarily molded of dielectric material such as plastic or the like. Each lever has an enlarged, ramped and serrated head portion 30 for engagement by an operator's thumb or finger. The lever has a pair of pivot trunnions 32 projecting from opposite sides of a body 40*a* for engagement within appropriate pivot holes in opposite ends 18*a* of housing 18, so that the levers pivot about the pivot trunnions as indicated by arrows "A" (FIGS. 1 and 3). In other words, pivot trunnions 32 define pivot points 28 described above. The slot 18*d* is sufficiently narrow to block inward movement of the lever 26, but the outer side of end 18*a* is open to allow the lever 26 to rotate outwardly.

Figure 6:
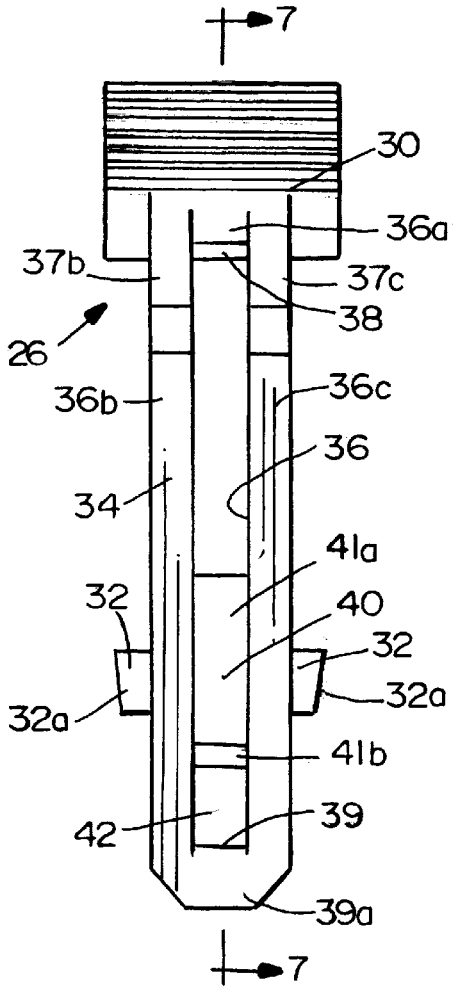
FIG. 6 is an inside elevational view of the lever.
Figure 5:
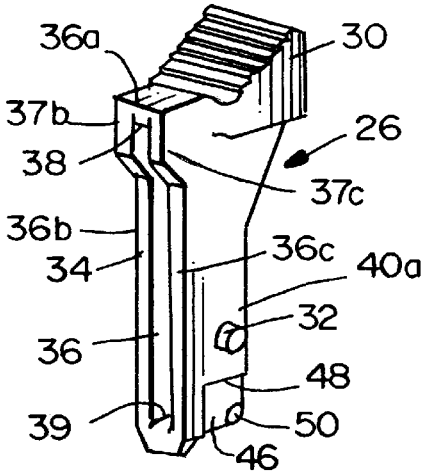
FIG. 5 is a perspective view of one of the latch/ejector levers.
Figure 7:
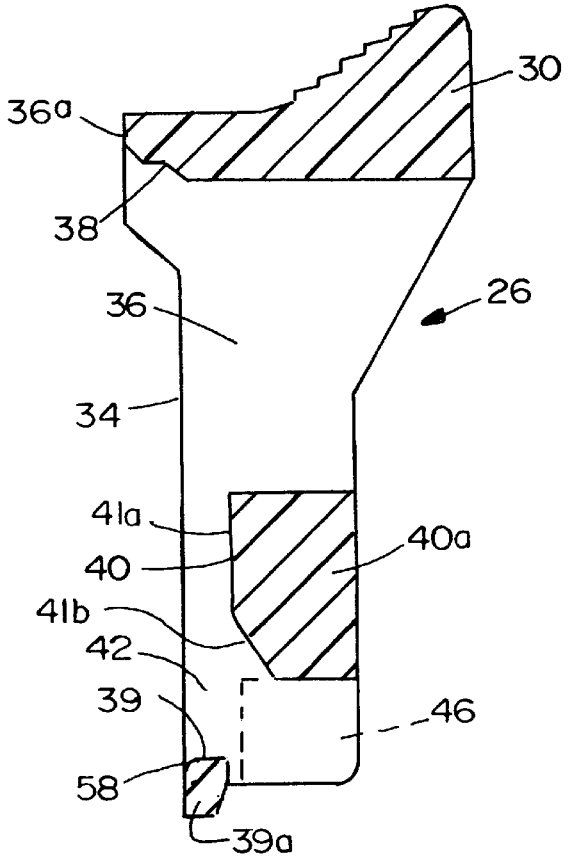
FIG. 7 is a section taken generally along line 7—7 of FIG. 6.

Still referring to FIGS. 5–8, each latch/ejector lever 26 includes a front face 34 which faces inwardly toward slot 20 of the connector assembly. A groove 36 is formed in the front face aligned with slot 20, and is defined by a top horizontal wall 36*a*, side vertical walls 36*b*, 36*c* and a horizontal bottom wall 39. The lever includes a latch portion 38 formed by the top wall 36*a* of the groove for holding circuit card 14 inserted into slot 20. The lever has an ejector portion formed by the bottom wall 39 of groove 36 for engaging the insertion edge 16 of the card at a corner thereof and ejecting the card from slot 20 in response to pivoting of the lever. A trapezoidally shaped foot portion 39*a* descends from the ejecting portion 39 to add strength to the ejecting portion 39. As best seen in FIGS. 6 and 7, the lever has a limiting portion at an inside wall 40 of groove 36 for limiting longitudinal movement of a side edge of card 14 when the card is inserted into slot 20. The limiting portion 40 is provided between the latch portion 38 and the eject portion 39 on the body portion 40*a*. The limiting portion comprises a vertical surface 41*a* and an inclined surface 41*b*. The lever has a hollow area 42 between ejector portion 39 and limiting portion 40 for receiving the corner of circuit card 14 when the lever is pivoted and the card is ejected. As best seen in FIGS. 5 and 7, latch portion 38 formed by the top wall 36*a* of groove 36 projects forwardly of front face 34, and ejector portion 39 formed by the bottom wall of groove 36 extends rearwardly of front face 34. Upper portions 37*b*, 37*c* of side walls 36*b* and 36*c* extend forwardly from the front face to support the top wall 36*a* of the latch portion 38.

Figure 8:
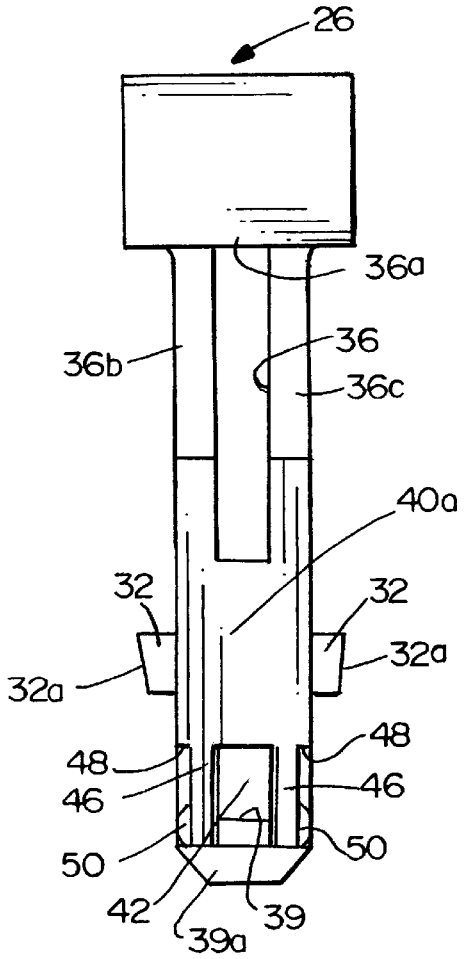
FIG. 8 is an outside elevational view of the lever.

Spaced flexible side walls 46 are provided at the bottom of lever 26. These side walls are best visible in FIG. 8 and, in essence, are formed by a bifurcated bottom end of the lever. Recesses 48 are formed in the outsides of the lever as best seen in FIGS. 5 and 8, so that side walls 46 are made sufficiently thin to provide adequate flexibility therefor. A rounded or semi-spherical detent 50 projects outwardly from each flexible side wall 46 for snappingly engaging detent recesses 52 (FIGS. 9 and 10) within housing 18 to hold the lever in a latched position shown in FIG. 9, holding circuit card 14 inserted into card-receiving slot 20 of the connector assembly. The recesses 52 are provided behind chamfered bosses 53. The hollow area 42 which accommodates the corner of circuit card 14 extends between flexible side walls 46. The foot portion 39*a* descends below bottom edges of side walls 46.

FIGS. 9 and 10 show the operation of one of the latch/ejector levers 26 in conjunction with circuit card 14. Turning first to FIG. 9, lever 26 is shown with latch portion 38 formed by the top wall of groove 36 in engagement with a latch notch 54 of circuit card 14. It can be seen that latch portion 38 extends forwardly of front face 34 of the lever. In this condition, insertion edge 16 of circuit card 14 has been inserted into slot 20 (FIGS. 1 and 2) of connector housing 18, and the contact pads on opposite sides of the circuit card are in engagement with the contact portions of terminals 22.

As seen in FIG. 9, circuit card 14 does not normally engage the vertical surface 41*a* of the limiting portion 40 formed by the inside wall of groove 36. Nevertheless, limiting portion 40 serves as an outer limit to longitudinal movement of the circuit card relative to the lever.

When it is desired to eject printed circuit card 14 from card edge connector assembly 12, latch/ejector levers 26 are rotated from the latched position shown in FIG. 9 to the ejecting position shown in FIG. 10, in the direction of arrow "B" (FIG. 10). Each lever rotates about pivot trunnions 32. During rotation, ejector portion 39 formed by the bottom wall of groove 36 enters into recess 19 and engages insertion edge 16 of circuit card 14 to eject the card in the direction of arrow "C". The inward rotation of lever in the direction of arrow "B" is limited by angled surface 19*b* when the front face 34 engages surface 19*b*. During insertion and ejection with the latch/ejector rotated in the direction of arrow "B", inclined surface 41*b* assumes a vertical orientation to limit longitudinal movement of the card 14. As clearly seen in FIG. 10, during ejection and insertion, a corner 60 of circuit card 14 is free to move within hollow area 42 between ejector portion 39 and limiting portion 40 of the lever. The hollow area extends between flexible side walls 46. By providing the ejector portion 39 rearwardly of the front face 34 and the hollowed area 42 to accommodate the reception of corner 54 of the circuit card, the overall length of the connector assembly is reduced. In addition, it can be seen that ejector portion 39 can engage insertion edge 16 further inwardly from side edge 56 of the circuit card when the open or hollowed area is provided for accommodating reception of the corner 54 of the card 14. This increases the moment arm of the lever which, in turn, increases the mechanical advantage of the lever and also increases the amount that the card is ejected for a given increment of rotation of the lever. The reverse operation takes place when the card 14 is inserted into the connector assembly 12.

FIG. 10 also shows that housing 18 has inside channels 62 in walls 18*b* for facilitating mounting levers 26 within opposite ends 18*a* of the housing. These channels accommodate pivot trunnions 32, and FIG. 6 shows that the outside faces 32*a* of the pivot trunnions are angled to facilitate insertion into channels 62 until the pivot trunnions snap into holes 64 in the housing at the bases of channels 62.

Finally, the forward edge or corner 58 of ejector portion 39 which engages insertion edge 16 of the circuit card is radiused or rounded as seen in FIG. 10 to prevent damage to the card material.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A card edge connector assembly for receiving a printed circuit card having an insertion edge insertable into and removable from the connector assembly, comprising:

an elongated dielectric housing having opposite ends with a card-receiving slot between the ends and a plurality of terminal-receiving cavities along the slot;

a plurality of conductive terminals received in said cavities and having contact portions extending into the slot for engaging contact pads on the printed circuit card; and a latch/ejector lever pivotally mounted on the housing at each opposite end thereof and having;

a front face;

a latch portion, extending forwardly from the front face, for holding the circuit card inserted into the slot;

an ejector portion extending only rearwardly from the front face, said ejector portion for engaging the insertion edge of the card at a corner thereof and ejecting the card from the slot in response to pivoting the lever;

a limiting portion between the latch portion and the ejector portion, for limiting longitudinal movement of a side edge of the card in the slot; and a hollow area between the ejector portion and the limiting portion for receiving the corner of the card when the lever is pivoted and the card is ejected.

2. The card edge connector assembly of claim 1 wherein each latch/ejector lever includes a groove for receiving the side edge of the printed circuit card, said ejector portion comprising a bottom wall of the groove.

3. The card edge connector assembly of claim 2 wherein said limiting portion comprises an inside wall of the groove.

4. The card edge connector assembly of claim 2 wherein said groove is formed in the front face of the lever.

5. The card edge connector assembly of claim 4 wherein said eject portion includes a foot portion descending from the eject portion below bottom edges of the lever.

6. The card edge connector assembly of claim 2 wherein said bottom wall has a radiused edge for engaging the insertion edge of the circuit card.

7. The card edge connector assembly of claim 1 wherein each latch/ejector lever includes a bottom end which is bifurcated to define spaced flexible side walls having detent means cooperating with detent means on said housing to releasable hold the lever in a latched position holding the circuit card inserted into the card-receiving slot.

8. The card edge connector assembly of claim 7 wherein said hollow area extends between said spaced flexible side walls.

9. A card edge connector assembly for receiving a printed circuit card having an insertion edge insertable into and removable from the connector assembly, comprising:

an elongated dielectric housing having a card-receiving slot and a plurality of terminal-receiving cavities along the slot;

a plurality of conductive terminals received in said cavities and having contact portions extending into the slot for engaging contact pads on the printed circuit card; and a lever pivotally mounted on the housing near an end of the slot and having a front face;

a groove in the front face defined by a top wall, a bottom wall and opposing spaced side walls;

a latch portion comprising said top wall extending forwardly of said front face;

an ejector portion comprising said bottom wall extending only rearwardly of said front face for engaging the insertion edge of the circuit card at a corner thereof and ejecting the card from the slot in response to pivoting the lever;

a limiting portion between the ejector portion and the latch portion for limiting longitudinal movement of a side edge of the card in the slot;

a hollow area between the ejector portion and the engaging portion for receiving the corner of the card when the lever is pivoted and the card is ejected; and said spaced side walls forming at least part of said hollow area.

10. The card edge connector assembly of claim 9 wherein said side walls are flexible and include detent means cooperating with detent means on said housing to releasably hold the lever in a latched position holding the circuit card inserted into the card-receiving slot.

11. The card edge connector assembly of claim 9 wherein said limiting portion comprises an inside wall of the groove.

12. The card edge connector assembly of claim 9 wherein said bottom wall has a radiused edge for engaging the insertion edge of the circuit card.

13. A card edge connector assembly for receiving a printed circuit card having an insertion edge insertable into and removable from the connector assembly, comprising:

an elongated dielectric housing having a card-receiving slot and a plurality of terminal-receiving cavities along the slot;

a plurality of conductive terminals received in said cavities and having contact portions extending into the slot for engaging contact pads on the printed circuit card; and a lever mounted on the housing having a top wall, a bottom wall, opposed spaced-apart side walls, and an inside wall defining a groove in a front face of said lever, the top wall providing a latching portion extending forwardly of said front face for engaging a notch in a side edge of the card and the bottom wall providing an ejector portion extending only rearwardly of the front face for engaging the insertion edge of the circuit card at a corner thereof and ejecting the card from the slot in response to pivoting the lever;

the inside wall providing a limiting portion for limiting longitudinal movement of a side edge of the card in between the latch portion and ejector portion of the slot, upper sections of the side walls extending forwardly of the front face to support said latch portion; and a hollow area between the ejector portion and the limiting portion for receiving the corner of the card when the lever is pivoted and the card is ejected.

14. The card edge connector assembly of claim 13 wherein a front portion descends below bottom edges of said side walls.

15. The card edge connector assembly of claim 13 wherein said bottom wall has a radiused edge for engaging the insertion edge of the circuit card.

* * * * *